US007815098B2

(12) United States Patent
Forman et al.

(10) Patent No.: US 7,815,098 B2
(45) Date of Patent: Oct. 19, 2010

(54) SELF-SEALING RECLOSABLE CARTON

(75) Inventors: Harold Forman, Pennsburg, PA (US); Robert E. Lincoln, Blandon, PA (US)

(73) Assignee: Sealstrip Corporation, Gilbertsville, PA (US)

( * ) Notice: Subject to any disclaimer, the term of this patent is extended or adjusted under 35 U.S.C. 154(b) by 282 days.

(21) Appl. No.: 12/026,591

(22) Filed: Feb. 6, 2008

(65) Prior Publication Data

US 2009/0194578 A1 Aug. 6, 2009

(51) Int. Cl.
*B65D 5/56* (2006.01)

(52) U.S. Cl. ..... 229/117.27; 229/164.2; 220/495.01

(58) Field of Classification Search ..... 229/117.27, 229/164.2, 132, 136, 117.28, 117.34, 117.33, 229/117.35; 220/495.01
See application file for complete search history.

(56) References Cited

U.S. PATENT DOCUMENTS

| | | | | |
|---|---|---|---|---|
| 2,216,527 A | | 10/1940 | Weiss | |
| 3,051,367 A | * | 8/1962 | Einhorn | 229/117.28 |
| 3,194,473 A | * | 7/1965 | Rumberger | 229/132 |
| 3,233,818 A | * | 2/1966 | Bixler et al. | 229/117.34 |
| 4,032,060 A | | 6/1977 | Bergstein | |
| 4,109,822 A | | 8/1978 | Egli | |
| 4,197,963 A | | 4/1980 | Nerenberg | |
| 4,577,762 A | * | 3/1986 | Kuchenbecker | 229/207 |
| 4,676,394 A | | 6/1987 | Hiersteiner | |
| 4,679,701 A | | 7/1987 | Ackermann et al. | |
| 4,872,588 A | | 10/1989 | Texidor | |
| 4,997,104 A | | 3/1991 | Pohl | |
| 5,405,198 A | | 4/1995 | Garrett | |
| 5,564,622 A | * | 10/1996 | Wald | 229/125.04 |
| 6,585,153 B2 | | 7/2003 | Ryan | |
| 2005/0047686 A1 | | 3/2005 | Elsaesser | |

* cited by examiner

*Primary Examiner*—Gary E Elkins
*Assistant Examiner*—Christopher Demeree
(74) *Attorney, Agent, or Firm*—Gore & Associates

(57) ABSTRACT

A resealable carton, having a product-containing bag liner, is constructed such that the liner bag is positively held in the folded, sealed condition by the incorporation of a fold support ledge which extends inwardly from an end wall of the carton. The bag is held against the support ledge by one of the closure flaps, which creates a tightly constructed U-shaped fold in which the bag is folded around the end of the closure flap. The liner is secured in that position in part by being captured between the top of the inner closure flap and an outer closure flap along a top run of the fold. A bottom fold is held between the support ledge and the inner closure flap. The support ledge may be formed in various ways including folding the end wall, embossing the end wall or forming the ledge by adding a bead of self-adhesive material to the end wall.

11 Claims, 3 Drawing Sheets

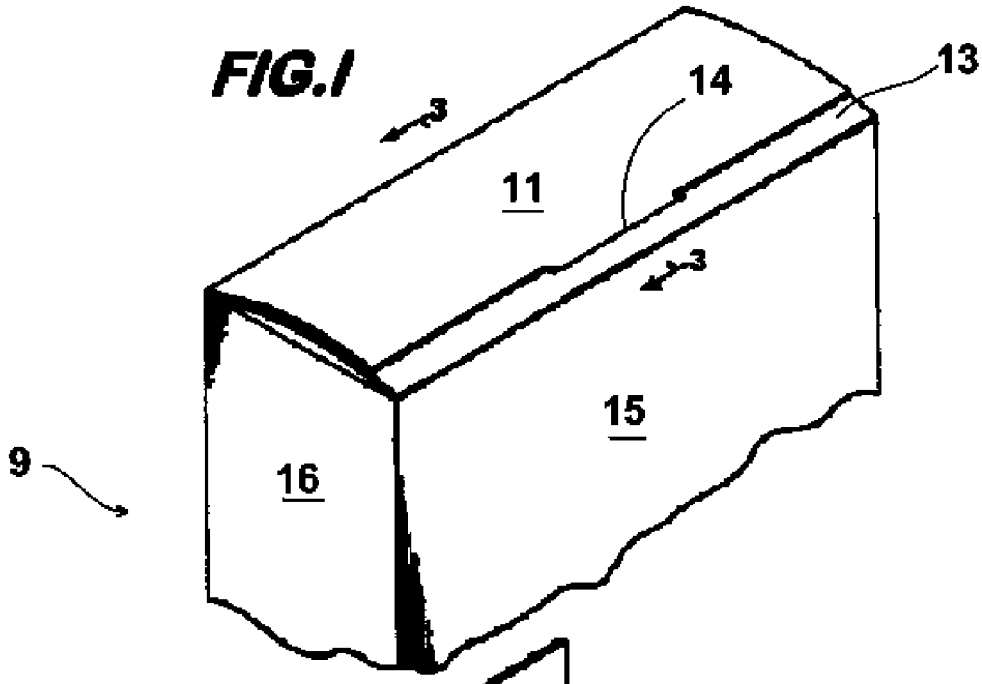
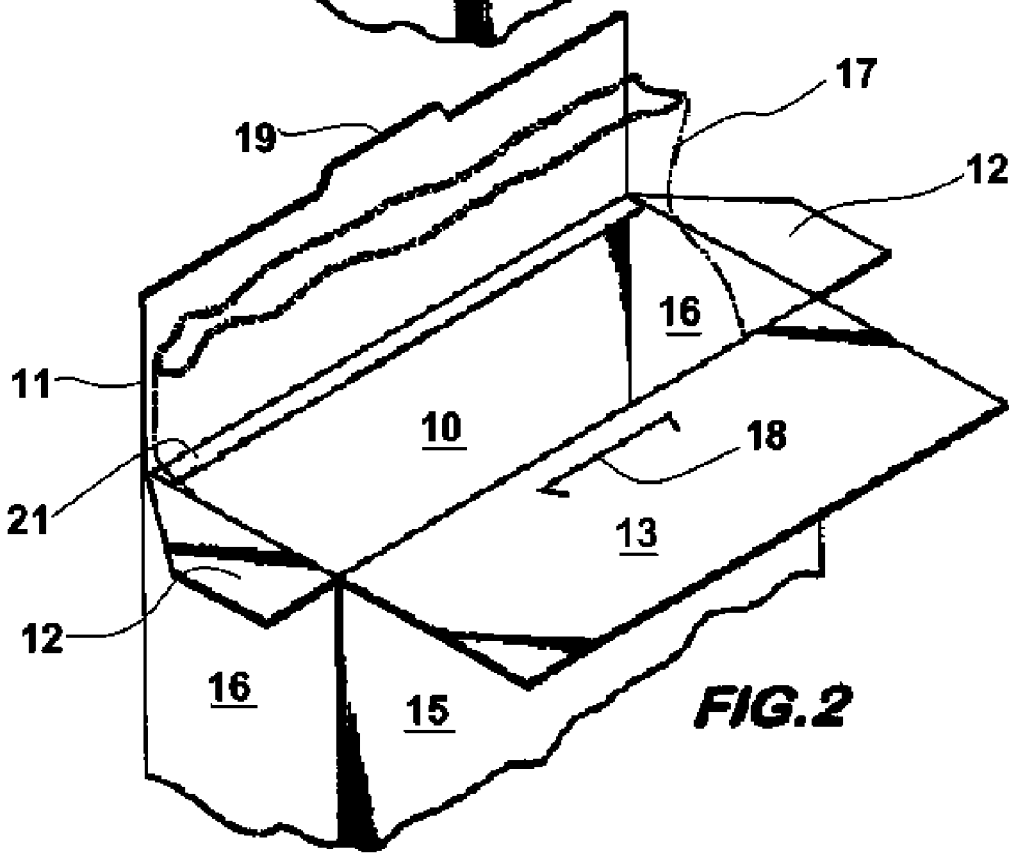
FIG.2

SELF-SEALING RECLOSABLE CARTON

FIELD OF THE INVENTION

This invention relates generally to reclosable cardboard cartons having closure flaps and a liner receptacle for products such as food items. More specifically, it relates to a carton with a liner that is tightly folded in a sealed condition by direct engagement with the closure flaps.

BACKGROUND OF THE INVENTION

Cartons having bag- or pouch-type liners for holding various types of food products, such as cereals and crackers, are widely used. When reclosing the carton, it is also known to enhance the sealing of the bag liner by direct engagement with closure flaps of the carton to ensure freshness of the food product, as disclosed in U.S. Pat. No. 6,585,153 entitled "Fresh Fold Package" or U.S. Pat. No. 4,872,588 entitled "Lined Carton." While the prior art has attempted to achieve a resealable liner bag for a food carton, the sealing effect is either limited or the construction of the carton is complex and requires a resealable adhesive. These attempts are either not economical to manufacture or not easy to use.

SUMMARY OF THE INVENTION

In order to overcome the deficiencies in the prior art described above, the applicant has devised a simple carton construction in which the liner bag is positively held in a folded condition by the incorporation of a fold support ledge which extends inwardly from an end wall of the carton. The bag is held against the support ledge by one of the closure flaps, which creates a tightly constructed U-shaped fold in which the bag is folded around the end of the closure flap. The liner is secured in that position in part by being captured between the top of the inner closure flap and an outer closure flap along a top run of the fold. A bottom run of the fold is held between the support ledge and the inner closure flap. The support ledge may be formed in various ways including folding the end wall, embossing the end wall or forming the ledge by adding a bead of self-adhesive material to the end wall. These are among other possibilities that would occur to one of skill in the art for forming a fold-supporting ledge below the end of the inner closure flap when the carton is in its closed condition.

More specifically, the applicant has invented a resealable container described as a carton having a pair of opposed side walls, opposed end and front walls and a bottom panel defining a container. A plurality of closure flaps are hingeably extending from top edges of the walls. One of the flaps is an inner closure flap connected along a top edge of the end wall. An outer closure flap is connected along a top edge of the front wall. The flaps overlap to close the carton, securing therein a flexible liner which includes opposing sheets with a closed bottom and an open top for storing a commodity. The length of the liner from top to bottom is greater than the length of the carton end wall. A fold support ledge extends forwardly from an inside surface of the end wall approximate its top edge.

When the container is in a closed condition, the inner closure flap extends substantially the entire depth of the container and the flexible liner is folded around the end of the inner closure flap, being held against the ledge and the inner closure flap along a bottom run of the fold. Along a top run of the fold, opposing sheets of the liner are compressibly held. The top run of the fold includes opposing sheets of the liner which are compressibly held between the inner closure flap and the outer closure flap, creating a substantially U-shaped, 180 degree fold. The end wall support ledge may be created by a fold in the end wall having top and bottom plates secured together by an adhesive. Alternatively, the support ledge may be formed by an embossment of the rear wall, which structurally provides a shelf member and an angled member extending downwardly from a front lip of the shelf member. In a third embodiment, the support ledge is formed by a self-adhesive bead of material, such as silicone, fixed to the end wall.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

Referring now to FIG. 1, a top left front isometric view of the carton of the invention is shown in its closed condition.

FIG. 2 is a top left front isometric view of the carton of the invention shown in its open condition with the liner bag depicted in phantom lines.

DESCRIPTION OF THE PREFERRED EMBODIMENT

Figure 3:
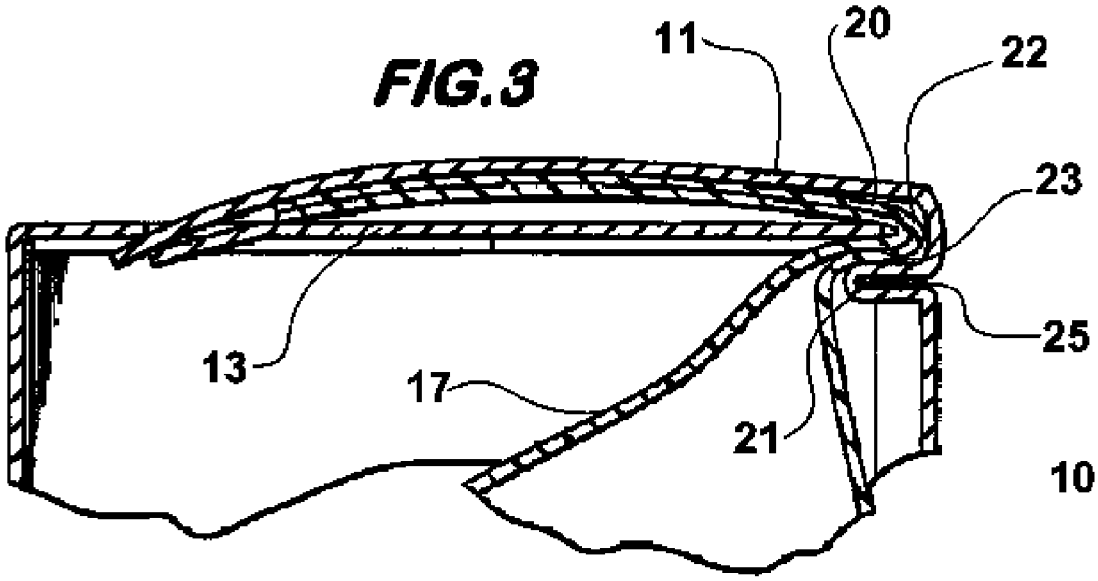
FIG. 3 is a right side sectional view taken from FIG. 1 as shown in that figure.

Referring now to FIG. 1, the container of the invention 9 is shown in its closed condition in which an outer closure flap 11 is secured to an inner closure flap 13 by away of a tongue-in-slot securement 14. A front wall 15 and an opposing rear wall (not shown) are affixed to opposing side walls 16, forming a carton having a substantially rectangular configuration.

FIG. 2 shows the container in an opened condition with the closure flaps 11, 12 and 13 hingeably extending from the top edges of their respective affixed walls: side walls 16, end wall 10 and front wall 15. Also shown in this figure is the flexible liner 17 which holds a commodity such as a dry food item. The inner closure flap 13 includes a slot 18 for receiving the tongue 19 of the outer closure flap 11 which overlays inwardly folded side flaps 12 to provide a closed condition of the carton as depicted in FIG. 1. By means of the flaps and walls of the container, a reclosable container for the flexible liner is provided. As further described herein with regard to FIGS. 3, 4 and 5, the carton end wall includes a support ledge 21 that configures a fold in the flexible liner which is held compressibly between the support ledge and the inner closure flap 13. As seen in this figure, the length of the flexible liner is substantially longer from top to bottom than the end wall 10 from top to bottom.

Referring now to FIG. 3, greater detail of the liner sealing fold is shown. The fold in liner 17 is U-shaped, having a substantially 180 degree configuration, with top and bottom runs 20 and 23, respectively, and a sharp end turn 22 which is made around the end of the inner flap 13. This provides a tighter fold seal than achievable by the prior art. The bottom run 23 of the fold is compressibly held between the support ledge 21 and the inner flap 13, while the top run 20 is compressibly held between the inner flap 13 and the outer flap 11. In this embodiment, the support ledge 21 is formed by opposing sides of a fold in the end wall 10 which are secured together by an adhesive 25.

Figure 4:
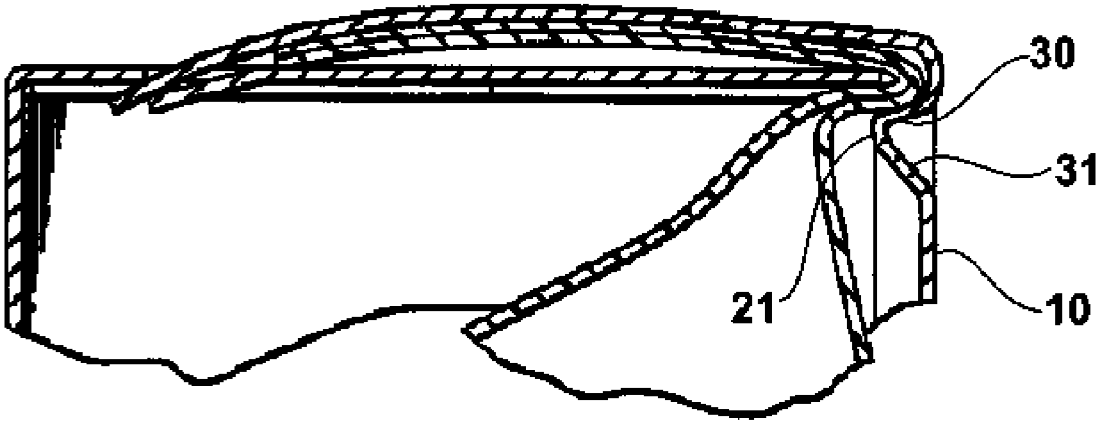
FIG. 4 is a right side sectional view of an alternate embodiment of the invention.
Figure 5:
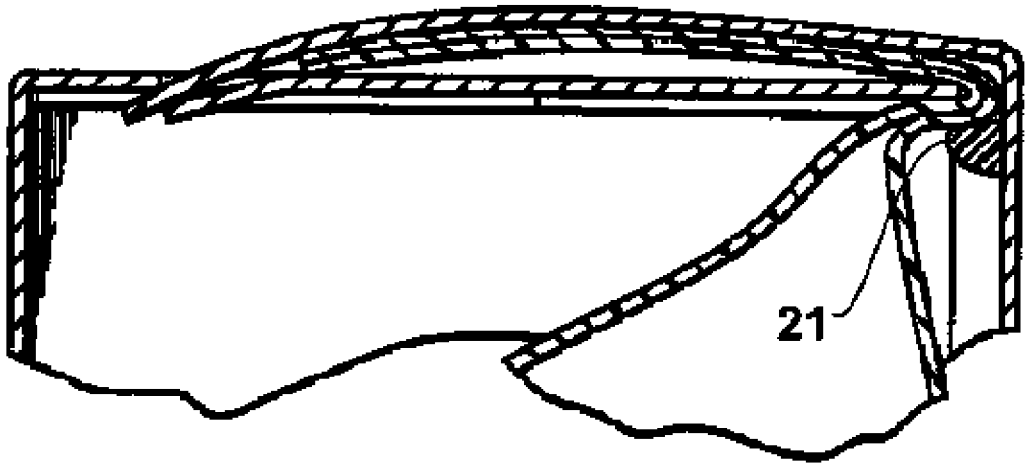
FIG. 5 is a right side sectional view of another alternate embodiment of the invention.

Referring now to FIGS. 4 and 5, configuration of the various structural elements shown in FIG. 3 are the same except for the formation of the support ledge 21. In FIG. 4, the support ledge is formed by an embossment in the end wall 10. The embossment includes a substantially horizontal top shelf portion 30 and downwardly extending angled portion 31. In FIG. 5, the support ledge 21 is formed by a bead of self-adhesive material such as silicone. In all embodiments, the support ledge extends substantially the entire width of the end wall.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A resealable container comprising:

a pair of opposed side walls;

opposed end and front walls, and a bottom panel, said walls and panels defining a container;

a plurality of closure flaps each hingeably extending from a top edge of one of said end wall, said front wall and said side walls, comprising:

at least two side flaps, each connected along a top edge of each of said side walls; and an inner closure flap connected along a top edge of said end wall and an outer closure flap connected along a top edge of said front wall;

a flexible liner including opposed sheets forming a receptacle having a closed bottom and an open top for storing a commodity within the container, the length of the liner from top to bottom being greater than the length of the end wall from top to bottom;

a support projection attached to and extending inwardly from an inside surface of said end wall spaced below the hinged connection between the inner closure flap and the end wall and spaced from the bottom wall; and wherein said inner closure flap extends substantially the entire depth of said container whereby in a closed condition of said container said liner is folded around an end of said inner closure flap and held between said inner closure flap and said outer closure flap along a top run of said fold, said fold having a bottom run where said liner is compressibly held between the top of said ledge and said inner closure flap.

2. The resealable container of claim 1 wherein said liner fold is U-shaped and that the liner sheets are pinched together being held in compression between the end of said inner closure flap and the end wall.

3. The resealable container of claim 2 wherein said liner fold top run comprises opposing sheets of said liner compressibly held between the inner closure flap and the outer closure flap.

4. The resealable container of claim 3 wherein said liner fold is a 180 degree fold.

5. The resealable container of claim 4 wherein said outer closure flap includes a tongue insertable into a slit in said inner closure flap for holding said flaps in a closed condition.

6. The resealable container of claim 5 wherein said ledge is unitary with said end wall being a fold in said end wall having opposing sides secured together by an adhesive therebetween.

7. The resealable container of claim 6 wherein said ledge is unitary with said end wall comprising a shelf member and an angled member extending downward from a front lip of front shelf member, said shelf member and said angled member being sides of an embossment of said end wall.

8. The resealable container of claim 7 wherein said ledge is composed entirely of a self-adherent bead of diverse material different from said end wall.

9. The resealable container of claim 8 wherein said bead is composed of silicone.

10. The resealable container of claim 1 wherein said ledge is substantially coextensive with the length of said end wall.

11. The resealable container of claim 1 wherein said container is a cardboard carton.

* * * * *